US007404243B1

(12) United States Patent
Sauder et al.

(10) Patent No.: US 7,404,243 B1
(45) Date of Patent: Jul. 29, 2008

(54) BIER

(75) Inventors: Myrl D. Sauder, Archbold, OH (US); Michael R. Morgan, West Unity, OH (US); Steve S. Robison, West Unity, OH (US)

(73) Assignee: Sauder Woodworking Co., Archbold, OH (US)

( * ) Notice: Subject to any disclaimer, the term of this patent is extended or adjusted under 35 U.S.C. 154(b) by 0 days.

(21) Appl. No.: 11/879,318

(22) Filed: Jul. 17, 2007

(51) Int. Cl.
*A61G 17/00* (2006.01)

(52) U.S. Cl. ..... 27/27; 211/85.16

(58) Field of Classification Search ..... 27/27; D99/9; 211/85.16; 312/139.2, 223.5; 108/23, 108/150

See application file for complete search history.

(56) References Cited

U.S. PATENT DOCUMENTS

| | | | | | |
|---|---|---|---|---|---|
| 981,486 | A | * | 1/1911 | Shaner | 312/139.2 |
| 1,443,185 | A | * | 1/1923 | Leitch | 108/166 |
| 1,492,998 | A | | 5/1924 | Meeker | |
| 1,550,295 | A | | 8/1925 | Weber et al. | |
| 1,558,558 | A | | 10/1925 | Metcalf | |
| 1,573,398 | A | | 2/1926 | Griffith | |
| 1,614,909 | A | | 1/1927 | Holfram | |
| 1,891,963 | A | | 12/1932 | Weber et al. | |
| D89,067 | S | * | 1/1933 | Hajny | D99/9 |
| 1,999,235 | A | | 4/1935 | Harrah | |
| 2,674,102 | A | | 4/1954 | Stile | |
| 2,753,236 | A | * | 7/1956 | Spring | 312/295 |
| D190,374 | S | * | 5/1961 | Lange | D99/9 |
| 3,037,648 | A | * | 6/1962 | Rupp | 414/530 |
| D203,044 | S | * | 11/1965 | Litchfield et al. | D99/9 |
| D209,198 | S | * | 11/1967 | Wareham et al. | D99/9 |
| D209,666 | S | * | 12/1967 | Wareham et al. | D99/9 |
| D214,668 | S | * | 7/1969 | Lange | D99/9 |
| D215,435 | S | * | 9/1969 | Ellsworth | D99/9 |
| 3,791,594 | A | | 2/1974 | Relly | |
| D257,183 | S | | 9/1980 | Bruce et al. | |
| D327,765 | S | * | 7/1992 | Roberts et al. | D99/9 |
| 5,197,169 | A | | 3/1993 | Gordon | |
| 5,405,017 | A | | 4/1995 | Szabo, Sr. et al. | |
| 5,524,394 | A | | 6/1996 | Gulick | |
| 5,533,241 | A | | 7/1996 | McConnell | |
| 5,586,376 | A | | 12/1996 | Enneking et al. | |
| 5,675,876 | A | | 10/1997 | Benedict et al. | |
| 5,709,052 | A | | 1/1998 | Szabo, Sr. et al. | |
| 5,797,499 | A | * | 8/1998 | Pinco | 211/13.1 |
| 5,848,498 | A | | 12/1998 | Szabo, Sr. et al. | |
| D404,884 | S | | 1/1999 | Salatin et al. | |
| D411,461 | S | | 6/1999 | Schultz | |
| D413,703 | S | | 9/1999 | Riga | |
| D418,961 | S | | 1/2000 | Biondo et al. | |
| 6,073,320 | A | | 6/2000 | Salatin et al. | |
| D433,585 | S | | 11/2000 | Bowers et al. | |

(Continued)

*Primary Examiner*—William L. Miller
(74) *Attorney, Agent, or Firm*—MacMillan, Sobanski & Todd, LLC

(57) ABSTRACT

A bier having a base including a base top surface. A first side is attached to the base top surface. The first side has a first side inside surface. A second side is attached to the base top surface. The second side has a second side inside surface. A cross member extends between the first side inside surface and the second side inside surface. The cross member has a front surface. A top is attached to the first side and the second side. The base top surface, the first side inside surface, the second side inside surface and the cross member inside surface form a display area.

9 Claims, 5 Drawing Sheets

U.S. PATENT DOCUMENTS

| | | | |
|---|---|---|---|
| 6,257,423 | B1 | 7/2001 | Riga et al. |
| 6,272,723 | B1 | 8/2001 | Rathjen |
| 6,317,945 | B1 | 11/2001 | Laphan et al. |
| 6,557,222 | B2 | 5/2003 | Groemminger et al. |
| 6,681,510 | B1 | 1/2004 | Salatin et al. |
| 6,691,385 | B2 | 2/2004 | Bell et al. |
| 6,836,936 | B1 | 1/2005 | Biondo et al. |
| 6,883,212 | B2 | 4/2005 | Groemminger et al. |
| 6,976,294 | B2 | 12/2005 | Biondo et al. |
| 7,036,196 | B2 | 5/2006 | Salatin et al. |
| 7,159,287 | B2 | 1/2007 | Parker et al. |

* cited by examiner

BIER

TECHNICAL FIELD

The invention relates generally to fixtures for displaying caskets. More specifically, the invention is directed to a bier.

BACKGROUND OF THE INVENTION

Caskets are used for the interment of the bodies of deceased persons. Prior to interment, the body of the deceased is typically displayed in a casket for the benefit of loved ones at a funeral. The use of a bier to support the casket at the funeral is known in the art. Typically, the displayed casket, supported by the bier, is flanked by floral arrangements and personal effects of the deceased. A bier should have a high quality finished furniture appearance. Further, the bier should have a display shelf for displaying the personal effects of the deceased in a tasteful and meaningful manner. The invention provides such a bier.

SUMMARY OF THE INVENTION

A bier has a base having a base top surface.

A first side is provided that is attached to the base top surface. The first side has a first side inside surface.

A second side is provided that is attached to the base top surface. The second side has a second side inside surface.

A cross member extends between the first side inside surface and the second side inside surface. The cross member has a front surface.

A top is provided that is attached to the first side and the second side.

The base top surface, the first side inside surface, the second side inside surface and the cross member inside surface form a display area.

DETAILED DESCRIPTION OF THE INVENTION

Figure 1:
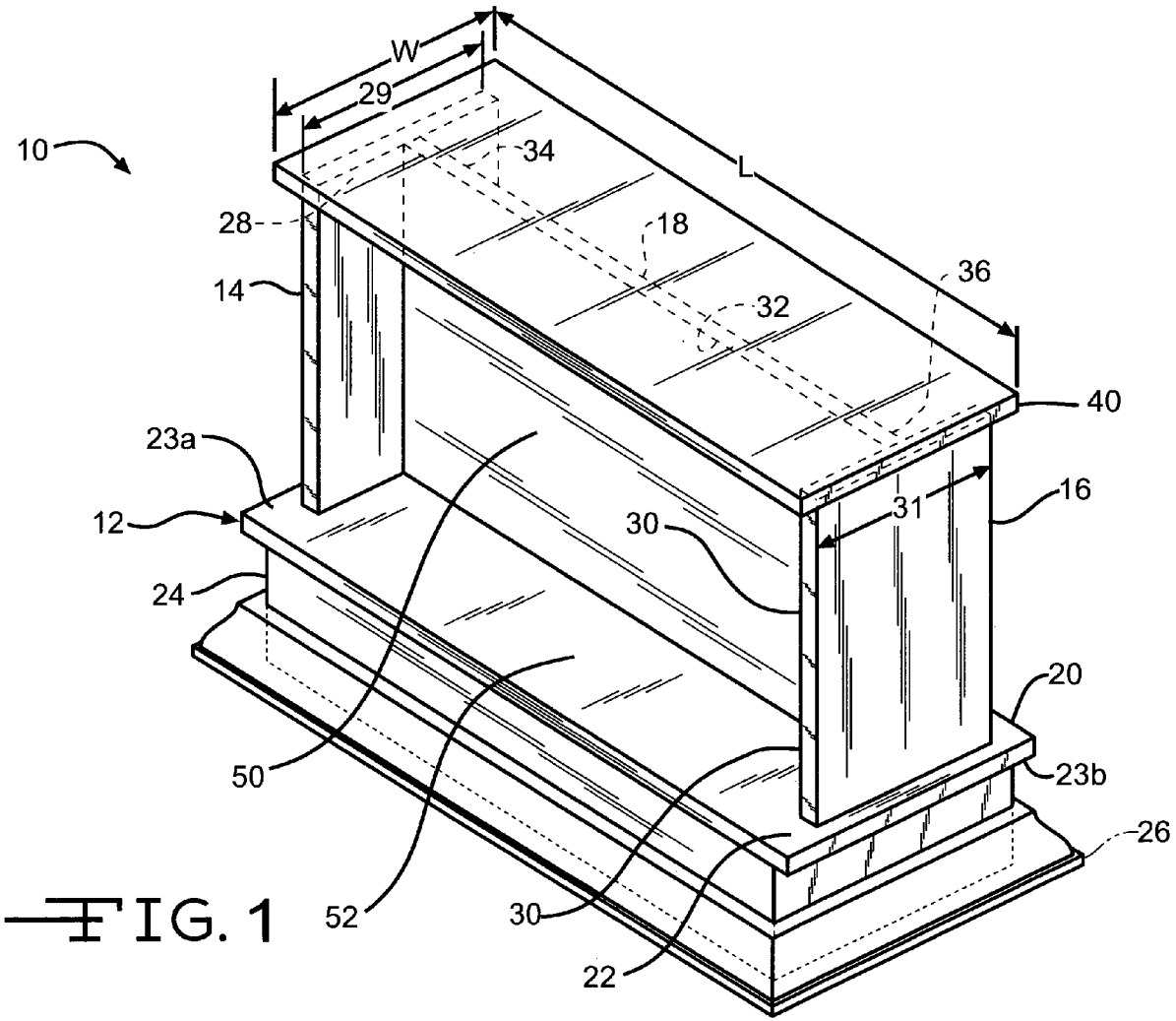
FIG. 1 is a perspective view of a bier according to the invention.
Figure 2:
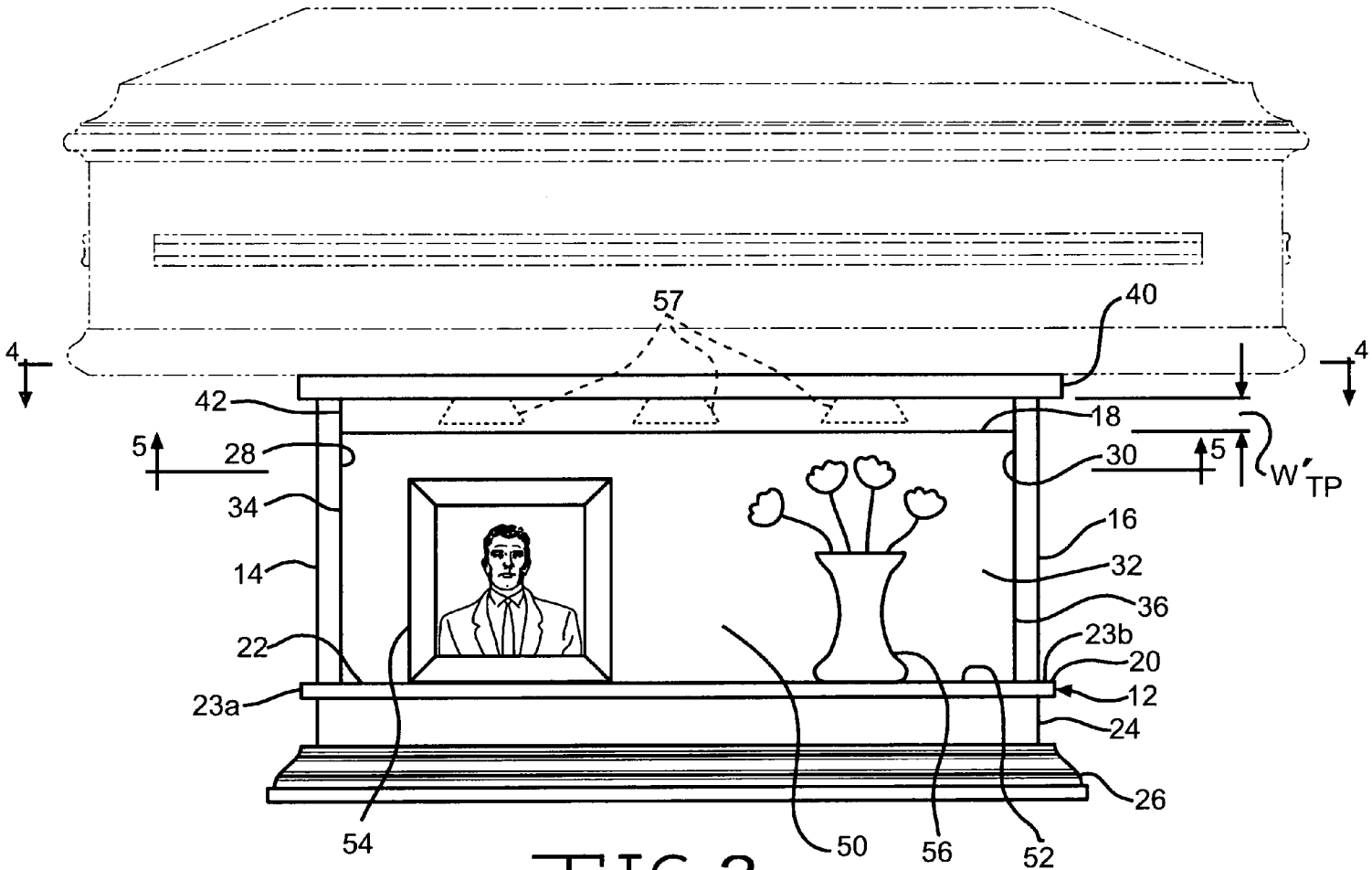
FIG. 2 is a front elevational view thereof.
Figure 3:
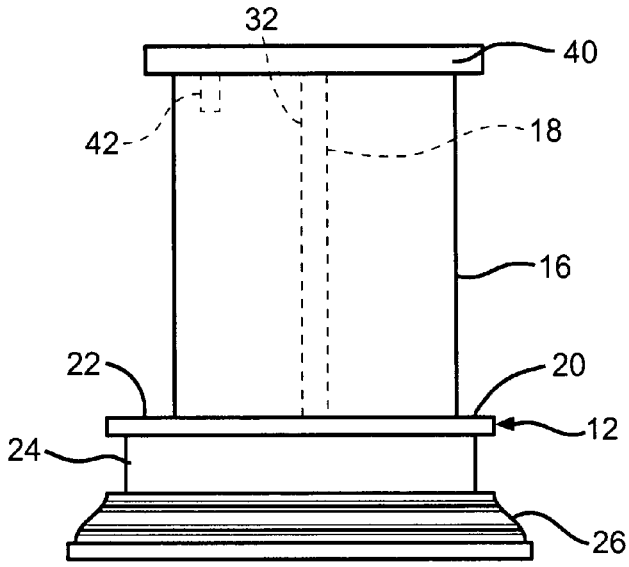
FIG. 3 is a right side elevational view thereof.
Figure 4:
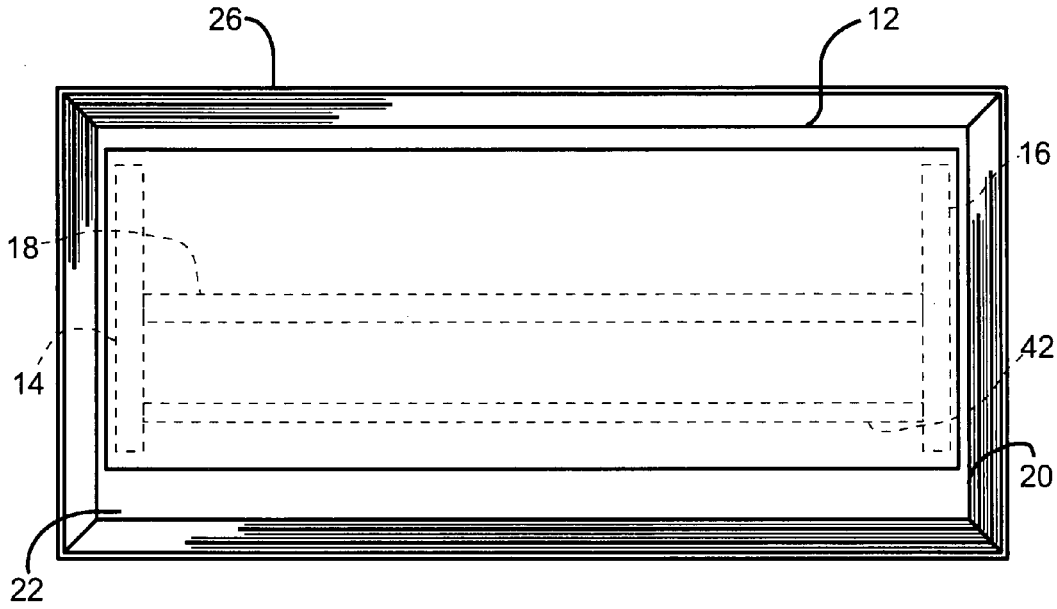
FIG. 4 is a top plan view thereof, taken along the line 4-4.

Referring to FIGS. 1 and 2, the bier 10 of the invention has a base 12, a first side 14, a second side 16, a cross member 18, a top 40 and a trim piece 42. The base 12 includes a base top 20. The base top 20 includes a base top surface 22, a base first end 23*a* and a base second end 23*b*. The base 12 also includes a base support 24. Optionally, the base 12 can include base molding 26 configured to present a finished-furniture appearance to the bier 10. As shown in FIGS. 1 and 2, the base molding 26 is a crown-style molding. Alternatively, the base molding 26 can be any molding structure, such as dentil molding, sufficient to present a finished-furniture appearance to the bier 10.

Referring to FIGS. 1 and 2, the first side 14 has a first side inside surface 28 and a first side length 29. The first side 14 is positioned on the base top surface 22 at the base first end 23*a*. Similarly, the second side 16 has a second side inside surface 30 and a second side length 31. The second side 16 is positioned on the base top surface 22 at the base second end 23*b*.

Still referring to FIGS. 1 and 2, the cross member 18 includes a cross member inside surface 32, a cross member first end 34 and a cross member second end 36. The cross member 18 extends between the first side 14 and the second side 16 such that the cross member first end 34 is attached to the first side inside surface 28 of the first side 14 and the cross member second end 36 is attached to the second side inside surface 30 of the second side.

As shown in FIG. 1, the top 40 is attached to the first side 14 and the second side 16. The top 40 has a length L and a width W. In the illustrated embodiment, the length L and width W of the top 40 are of sufficient size so as to overhang the first and second sides, 14 and 16. Alternatively, the length L and width W of the top 40 can be of sufficient length and width respectively so as to be flush with the first and second sides, 14 and 16.

As best shown in FIG. 2, the trim piece 42 extends between the first side inside surface 28 and the second side inside surface 30. In one embodiment, a first end of the trim piece 42 is attached to the first side inside surface 28 and the other end of the trim piece 42 is attached to the second side inside surface 30. Alternatively, the trim piece 42 can be attached to the top 40. The trim piece 42 is configured to provide a finished-furniture appearance and to hide optional lights 57 from view. The trim piece 42 can have any width $W_{tp}$ sufficient to provide a finished-furniture appearance and to hide the optional lights 57 from view.

In one embodiment of the bier 10, the base 12, first side 14, second side 16, cross member 18, top 40 and trim piece 42 are made of particleboard having laminated surfaces and laminated edges. In another embodiment, the base 12, first side 14, second side 16, cross member 18, top 40 and trim piece 42 can be made of other materials.

As shown in FIG. 1, the base top surface 22, first side inside surface 28, second side inside surface 30 and cross member inside surface 32 form a display area 50. The portion of the base top surface 22 within the display area 50 forms the display shelf 52. The display shelf 52 and the display area 50 are configured for placement of articles such photographs 54, floral arrangements 56 and other personal effects of the deceased (not shown).

Figure 5:
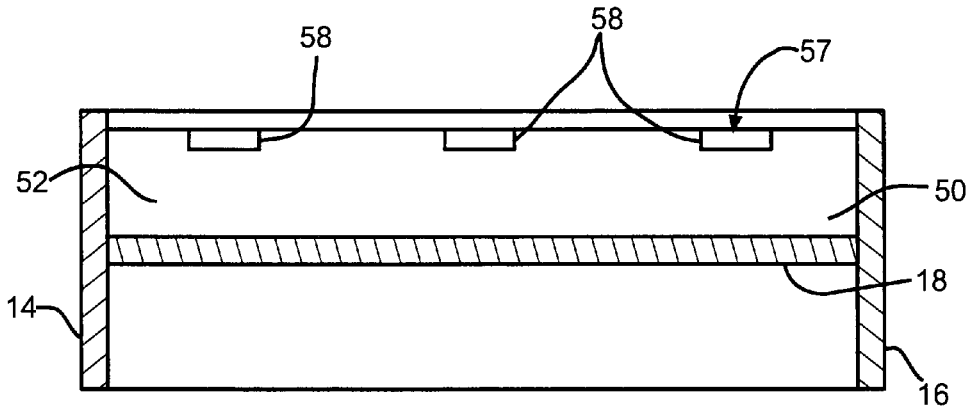
FIG. 5 is a cross-section view thereof, taken along the line 5-5.

As shown in FIGS. 2 and 5, the bier 10 includes a lighting system 57. The light system 57 is configured to illuminate the articles disposed in the display area 50 and on the display shelf 52. In the illustrated embodiment, the lighting system 57 includes a plurality of individual lights 58 attached to the top 40 and positioned adjacent to the trim piece 42. Alternatively, the individual lights 58 can be attached to another structural member, such as for example the trim piece 42, the first side 14 or the second side 16. While the illustrated embodiment shows three lights 58, it should be understood that any number of lights 58 can be used. In the illustrated embodiment, the lights 58 are low-power lights commonly used for curio cabinets. Alternatively, the lights 58 can be any light type of light, such as for example fluorescent lights or rope lights, sufficient to illuminate the articles placed in the display area 50 and on the display shelf 52.

Figure 6:
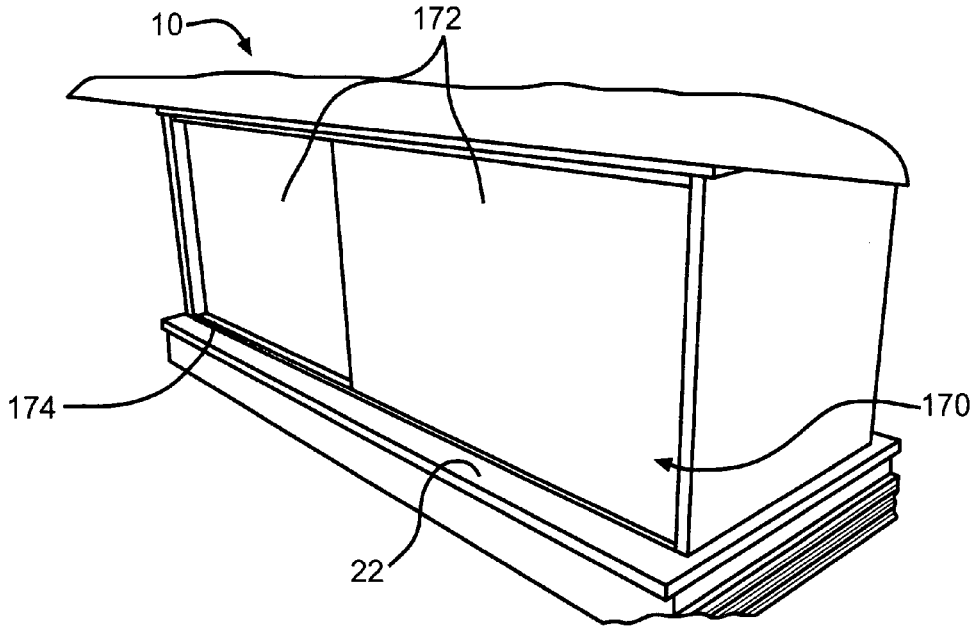
FIG. 6 is a perspective view of a second embodiment bier according to the invention showing doors positioned in front of the display area.
Figure 7:
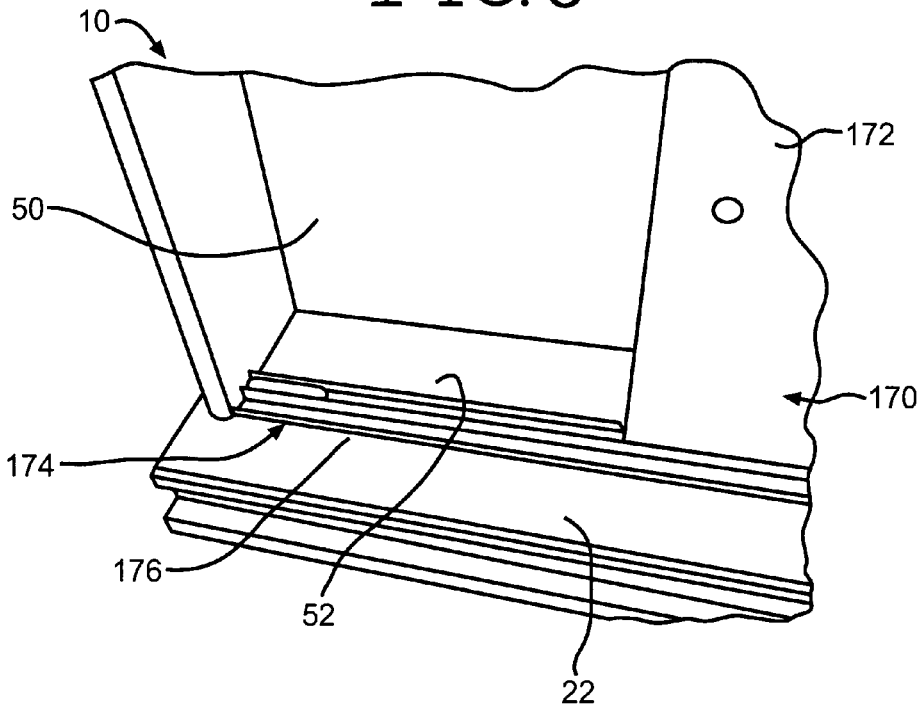
FIG. 7 is a perspective view similar to FIG. 6 in which a door is shown in an open position.

Referring to FIGS. 6 and 7, a second embodiment bier 10 according to the invention is shown. In the second embodiment, the bier 10 as described above includes a door system 170. In a closed position as shown in FIG. 6, the door system 170 is configured to prevent viewing of the display area 50 and the display shelf 52. In an open position as shown in FIG. 7, the door system 170 is configured to allow viewing of a portion of the display area 50 and the display shelf 52. In the illustrated embodiment, the door system 170 includes a plurality of doors 172. While the illustrated embodiment shows two doors 172, any number of doors 172 can be used. As further shown in FIGS. 6 and 7, the doors 172 are slidable within a track system 174. In this embodiment, the track system 174 includes top and bottom tracks 176 attached to the top 40 and the base top surface 22. While the bottom track 176 shown in FIGS. 6 and 7 sits on top of the base top surface 22, it should be understood that the bottom track 176 can be recessed within the base top 20 such that the bottom track 176 is flush with the base top surface 22. The track system 174 shown in FIGS. 6 and 7 extends in a substantially straight line from the first side 14 to the second side 16. Alternatively, the track system 174 can have a curved shape. In yet another embodiment, the track system 174 can bend toward the cross member 18 at the first side 14 and the second side 16 to provide for articulated doors. While the embodiment shown in FIGS. 6 and 7 include a plurality of slidable doors 172, it should be understood that other types of doors, such as for example swinging doors can be used.

While the invention has been described with reference to particular embodiments, it should be understood that various changes may be made and equivalents may be substituted for elements thereof without departing from the essential scope of the invention. In addition, many modifications may be made to adapt a particular situation or material to the teachings of the invention without departing from the essential scope thereof. Therefore, it is intended that the invention not be limited to the particular embodiments, but that the invention shall include all embodiments falling within the scope of the claims.

We claim:

1. A casket bier for supporting a casket, comprising:

a base having a base top surface;

a base support for supporting the base, a lower portion of the base support being adapted for positioning proximate a supporting surface for the bier;

a first side attached to the base top surface, the first side having a first side inside surface;

a second side attached to the base top surface, the second side having a second side inside surface;

a cross member extending between the first side inside surface and the second side inside surface, the cross member having a front surface; and a top attached to the first side and the second side, the top having an upper surface and a lower surface, the upper surface for supporting the casket thereon;

the base top surface, the first side inside surface, the second side inside surface, the cross member inside front surface, and the lower surface of the top forming a display area;

wherein the display area is illuminated by a light located within the display area.

2. The casket bier of claim 1, wherein the area of the base top surface within the display area forms a display shelf.

3. The casket bier of claim 2, wherein the display shelf is of sufficient size to accommodate a picture frame.

4. The casket bier of claim 1, wherein a trim piece extends between the first side inside surface and the second side inside surface.

5. The casket bier of claim 4, wherein the trim piece is attached to the top.

6. The casket bier of claim 1, wherein the light is a low voltage light.

7. The casket bier of claim 1, wherein the display area is enclosed by doors.

8. The casket bier of claim 7, wherein the doors are slidable within a track system.

9. A casket bier for supporting a casket, comprising:

a base having a base top surface;

a first side attached to the base top surface, the first side having a first side length and a first side inside surface;

a second side attached to the base top surface, the second side having a second side length and a second side inside surface;

a cross member extending between the first side inside surface and the second side inside surface, the cross member having a front surface, the cross member being positioned substantially in the center of the first side length and the second side length; and a top attached to the first side and the second side, the top having an upper surface and a lower surface, the top upper surface for supporting the casket thereon;

the base top surface, the first side inside surface, the second side inside surface, the cross member front surface, and the lower surface of the top forming a display area;

wherein the display area is illuminated by a light located within the display area.

* * * * *